US010787308B1

(12) United States Patent
Larson

(10) Patent No.: US 10,787,308 B1
(45) Date of Patent: Sep. 29, 2020

(54) GIFT CARD PRESENTATION DEVICE

(71) Applicant: American Greetings Corporation, Cleveland, OH (US)

(72) Inventor: Seth Larson, Lakewood, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 16/374,516

(22) Filed: Apr. 3, 2019

(51) Int. Cl.
*B65D 83/12* (2006.01)
*A45C 11/18* (2006.01)
*B42D 15/04* (2006.01)

(52) U.S. Cl.
CPC ..... *B65D 83/12* (2013.01); *A45C 11/18* (2013.01); *B42D 15/045* (2013.01)

(58) Field of Classification Search
None
See application file for complete search history.

(56) References Cited

U.S. PATENT DOCUMENTS

| | | | | |
|---|---|---|---|---|
| 2,997,807 | A | 4/1960 | Woron | |
| 3,058,259 | A | 8/1961 | Kripak | |
| 3,765,120 | A | 10/1973 | Waak | |
| 8,152,058 | B2 | 4/2012 | Halbur et al. | |
| 8,568,193 | B1 | 10/2013 | Evans et al. | |
| 8,985,387 | B2 * | 3/2015 | Kobayashi | A45C 11/182 221/154 |

* cited by examiner

*Primary Examiner* — Gene O Crawford
*Assistant Examiner* — Ayodeji T Ojofeitimi
(74) *Attorney, Agent, or Firm* — Christine Flanagan

(57) ABSTRACT

A gift card presentation device that is operative to receive a gift card (or gift card holder) therein. The gift card presentation device contains a spring-loaded lever panel which is operative to move an internal spring (or springs) between a compressed and uncompressed states. The spring controls movement of a gift card or gift card holder placed into an opening on the gift card presentation device. When the lever moves the spring from the compressed state to the uncompressed state, the gift card is completely ejected from the gift card holder presentation device.

19 Claims, 5 Drawing Sheets

GIFT CARD PRESENTATION DEVICE

RELATED APPLICATIONS

There are no applications related to this application.

FIELD OF THE INVENTION

The present invention is in the field of social expression products. More specifically, the invention is directed to a gift card presentation device with special effects.

SUMMARY OF THE INVENTION

In one embodiment, the gift card presentation device of the present disclosure and related inventions includes a device having a front surface and a rear surface opposite the front surface; four perimeter surfaces between the front and rear surfaces, and a cavity contained between the front, rear and four perimeter surfaces; a spring loaded lever panel attached to a lever arm; a push button with a catch arm; and a gift card holder inserted within a slot located on one of the four perimeter surfaces of the device, the gift card holder resting on a portion of the spring loaded lever panel. Pushing the push button causes the spring loaded lever panel to move from a first position at a lower region of the device to a second position at an upper region of the device and also causes the gift card holder to be completely ejected from the device.

In another embodiment, the gift card presentation device includes a faux toaster having a front surface, rear surface, right and left perimeter surfaces and upper and lower perimeter surfaces; at least one spring contained within the faux toaster, the at least one spring operative to move between a compressed and non-compressed state; a lever contained inside of the faux toaster which is attached to the at least one spring; a lever arm attached to the lever which extends outward from the right perimeter surface of the faux toaster; a push button which is removably attached to the lever; and a gift card holder shaped like a slice of bread, the gift card holder located atop portion of the lever. When the push button is attached to the lever arm, the at least one spring is in a compressed state and pushing the push button releases the lever from the push button, causing the spring to return to an non-compressed state and thereby moving the lever in an upward direction and forcing the gift card holder from within the faux toaster.

In still another embodiment, the gift card presentation device includes a device body having a cavity contained therein; a lever contained within the cavity in the device body; a push button releasably attached to the lever; a gift card holder partially contained within the device body; and one or more springs attached at one end to an internal surface of the device body and at an opposite end to the lever. Attaching the lever to the push button forces the one or more springs into a compressed state and pushing the push button releases the lever from the push button, causes the one or more springs to return to an uncompressed state, forces the lever in an upward direction and ejects the gift card holder from within the device body.

DETAILED DESCRIPTION OF PREFERRED AND ALTERNATE EMBODIMENTS

Figure 2:
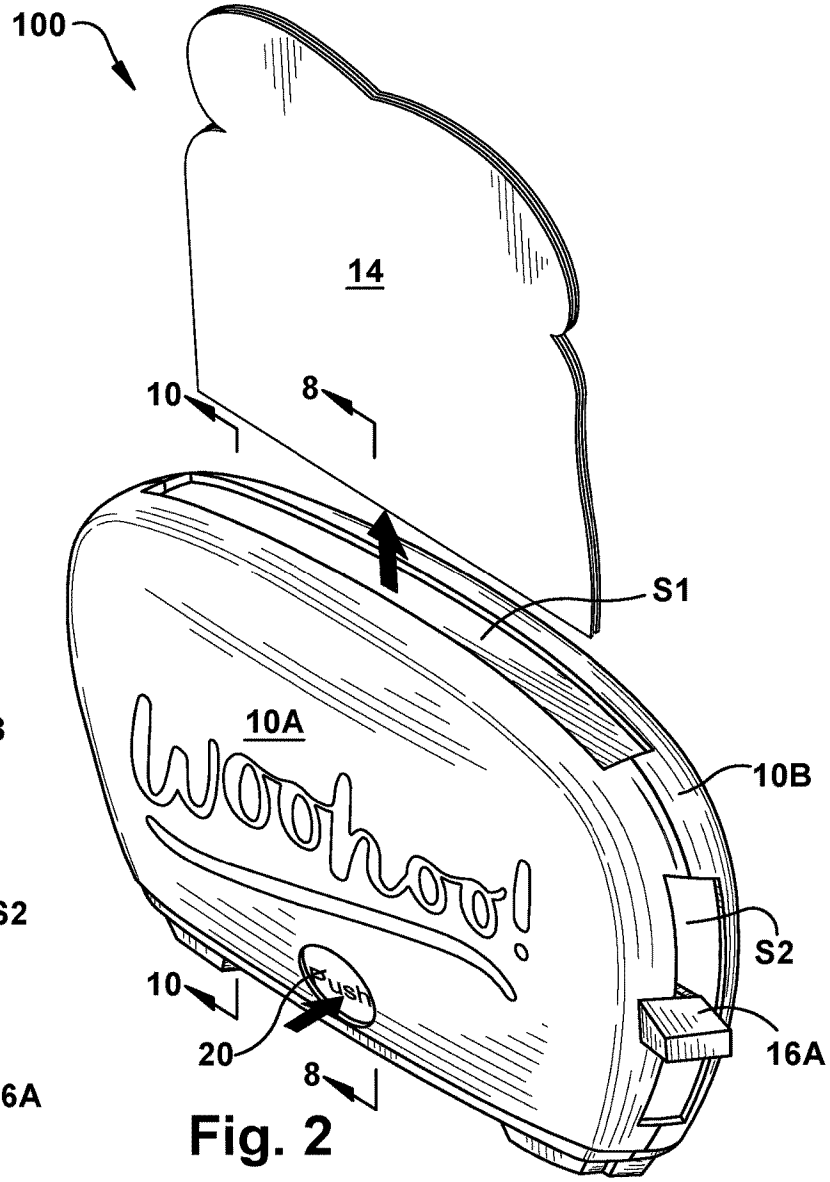
FIG. 2 is a perspective view of the gift card holder of FIG. 1, in a second state.

The present disclosure and related inventions include a gift card presentation device 10 that is operative to receive a gift card 12 (or gift card holder, sleeve or miniature greeting card 14) therein. The gift card presentation device 10 contains a spring-loaded lever panel 16 which is operative to move an internal spring (or springs) 18 between a compressed and uncompressed states. The spring 18 controls movement of a gift card 12 or gift card holder 14 placed into an opening on the gift card presentation device 10. When the lever 16 moves the spring 18 from the compressed state to the uncompressed state, the gift card 12 is completely ejected from the gift card holder presentation device 10. As used herein the term "gift card holder" 14 encompasses any type of structure used to house or hold a gift card. Examples include, but are not limited to: a gift card sleeve, a miniature gift card, an envelope, a pocket, etc.

Figure 1:
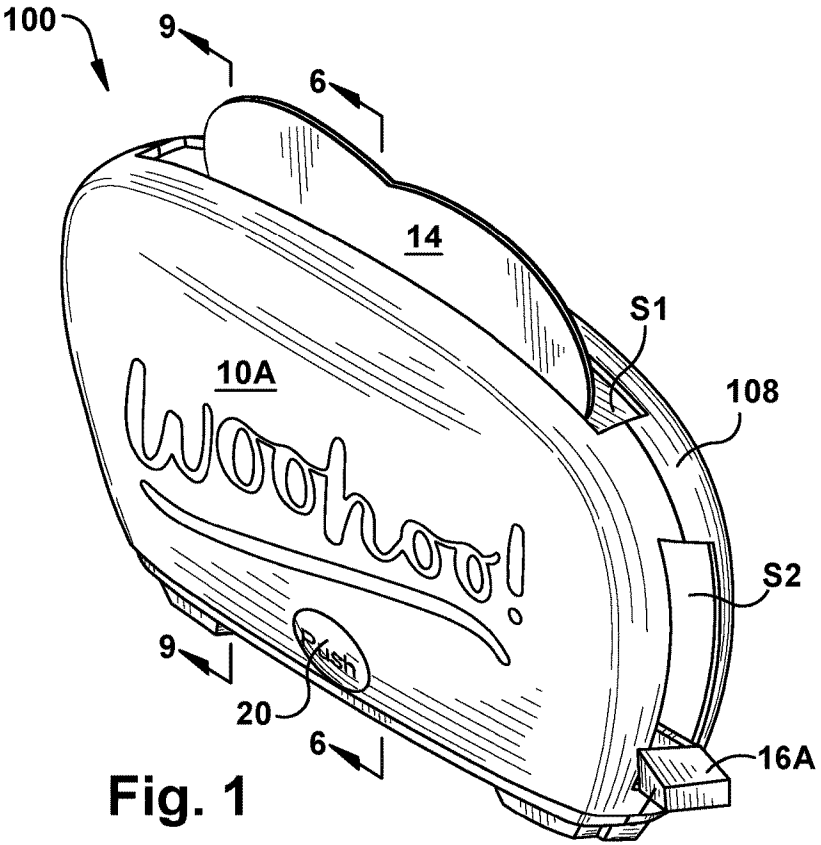
FIG. 1 is a perspective view of the gift card holder of the present invention, in a first state.

In one embodiment, the gift card presentation device 10 of the present disclosure and related inventions is shaped and modeled as a miniature toaster, as shown in FIGS. 1 and 2. In other embodiments, the gift card presentation device 10 may be shaped and modeled as any other type of appliance, item, object, or character. The gift card presentation device 10, in one embodiment, contains a substantially square or rectangular shape, having a front surface panel 10A and a rear surface panel 10B, opposite the front surface panel 10A. The front and rear surface panels 10A, 10B are attached to one another and form an upper perimeter surface P1, a lower perimeter surface P2 opposite the upper perimeter surface P1, a right perimeter surface P3 and a left perimeter surface P4 opposite the right perimeter surface P3, the right and left perimeter surfaces P3, P4 spanning between the upper and lower perimeter surfaces P1, P2. The combined front and rear surface panels 10A, 10B create a cavity therebetween. The upper perimeter surface P1 may contain an elongate (horizontal) slot 51 or opening thereon, into which a gift card 12 or gift card holder 14 may be inserted. The right side perimeter surface P3 may also contain an elongate (vertical) slot S2 or opening through which a portion of the lever panel 16 may protrude. In one embodiment, the gift card presentation device 10 is made of an extruded plastic material, although other materials, such as, metal or cardboard have been contemplated and are considered to be within the scope of the present invention. The gift card presentation device 10 may contain further shapes and embellishments to strengthen its appearance as a faux toaster (or other item or object). For example, the lower perimeter surface P2 may be shaped to contain what appears to be four feet. Additionally, letters, words, shapes or images may be molded into the plastic material. Alternatively, the gift card presentation device 10 may contain printing thereon, stickers adhered thereto, or other such embellishments.

Figure 3:
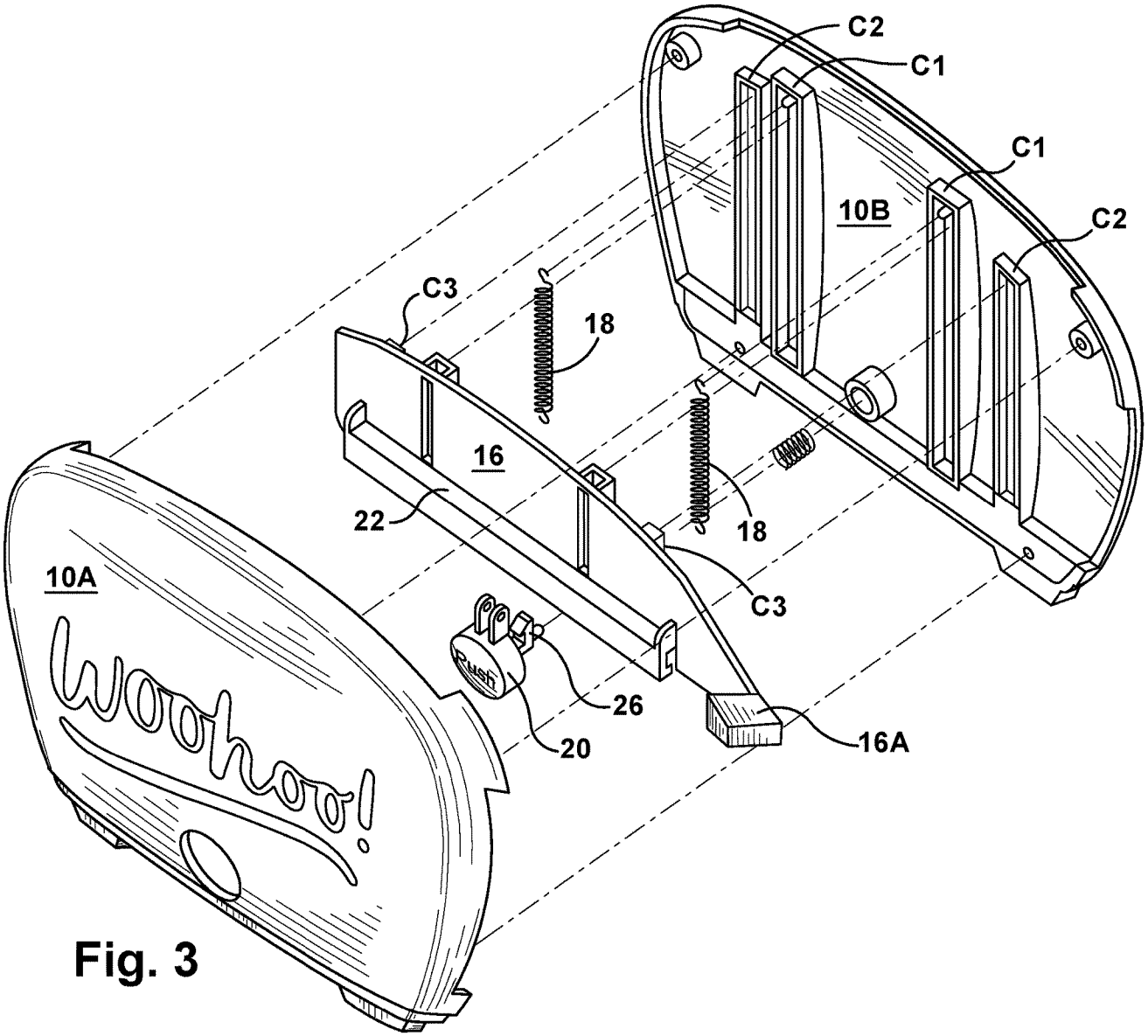
FIG. 3 is a exploded view of the gift card holder of FIG. 1.
Figure 4:
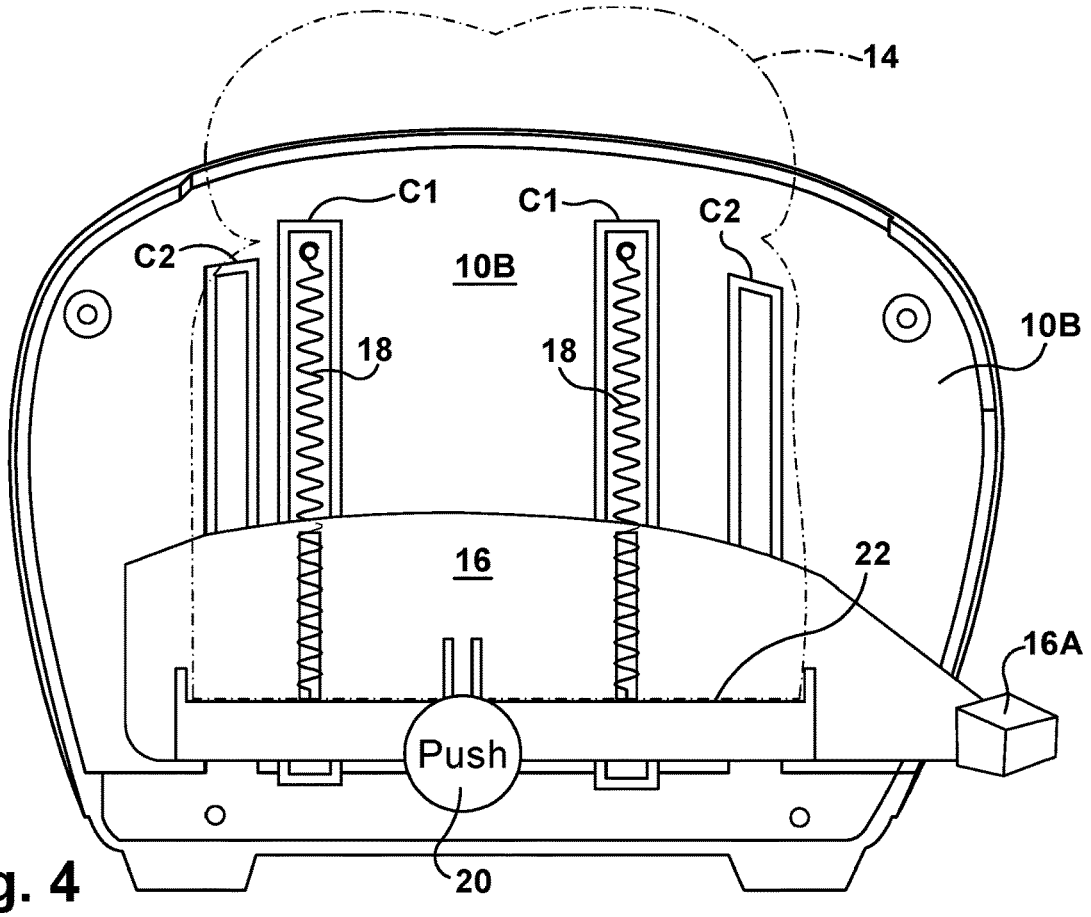
FIG. 4 is a front internal view of the gift card holder of FIG. 1.
Figure 5:
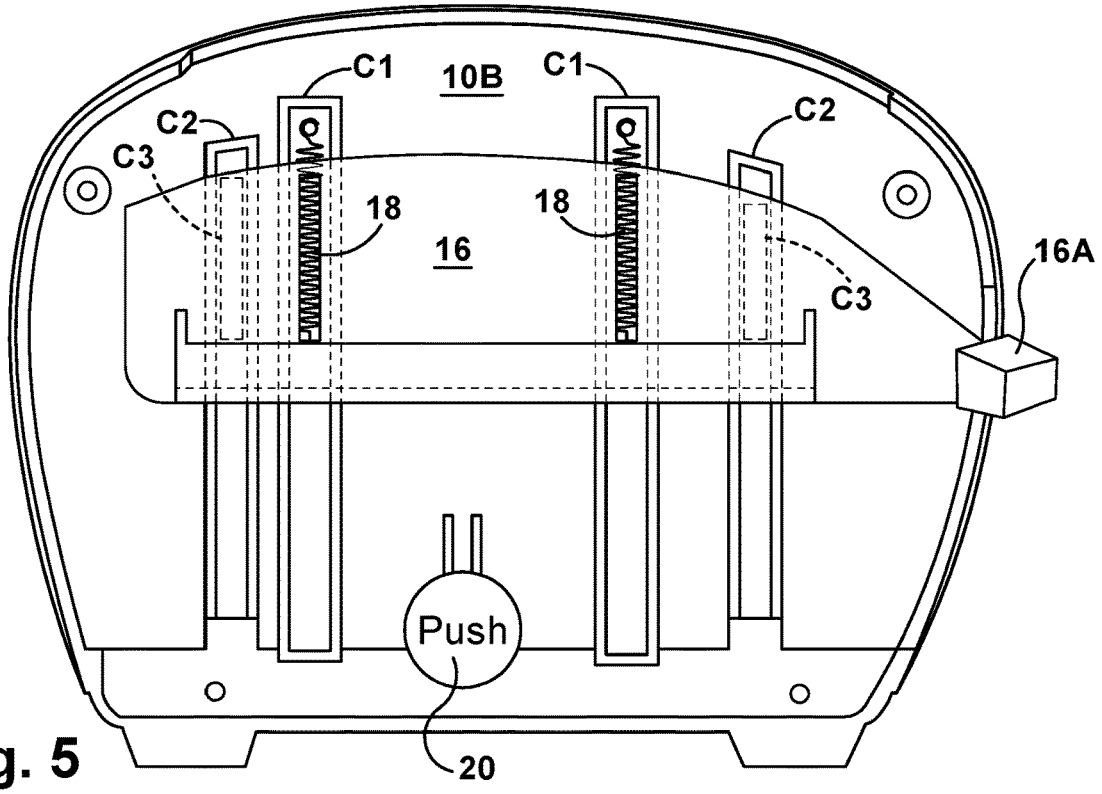
FIG. 5 is a front internal view of the gift card holder of FIG. 2.
Figure 8:
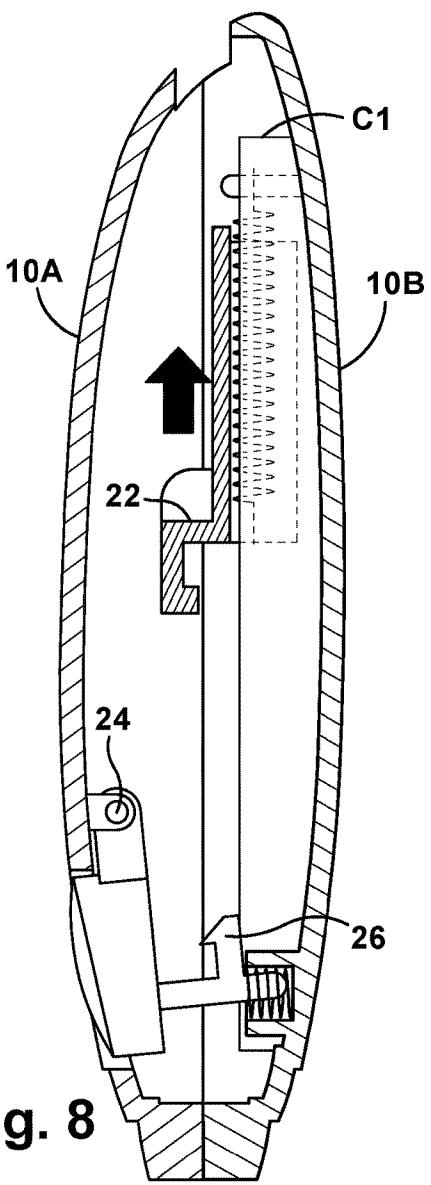
FIG. 8 is a cross-sectional view of the gift card holder of FIG. 2, in the direction of arrows 8-8.
Figure 7:
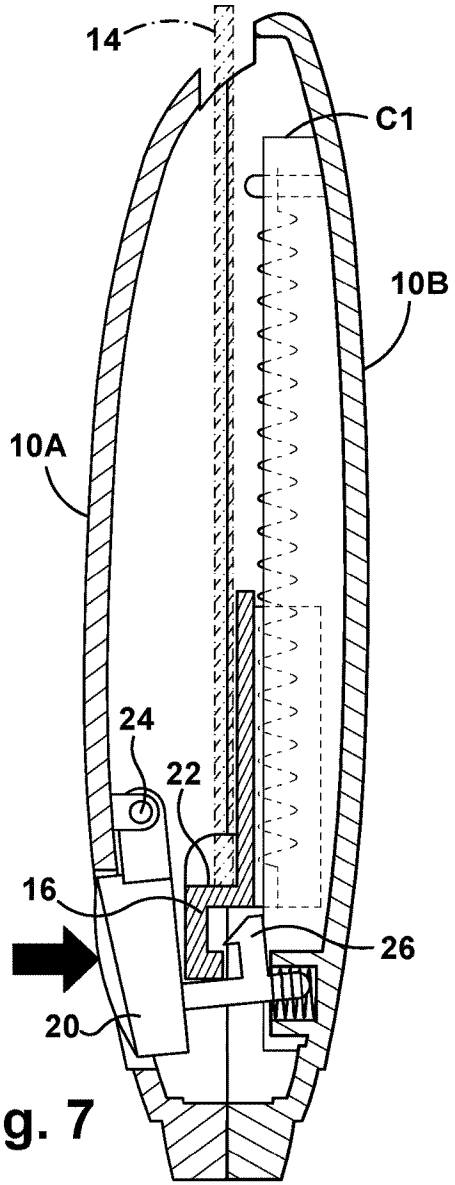
FIG. 7 is a cross-sectional view of the gift card holder, in a state between FIGS. 1 and 2.
Figure 6:
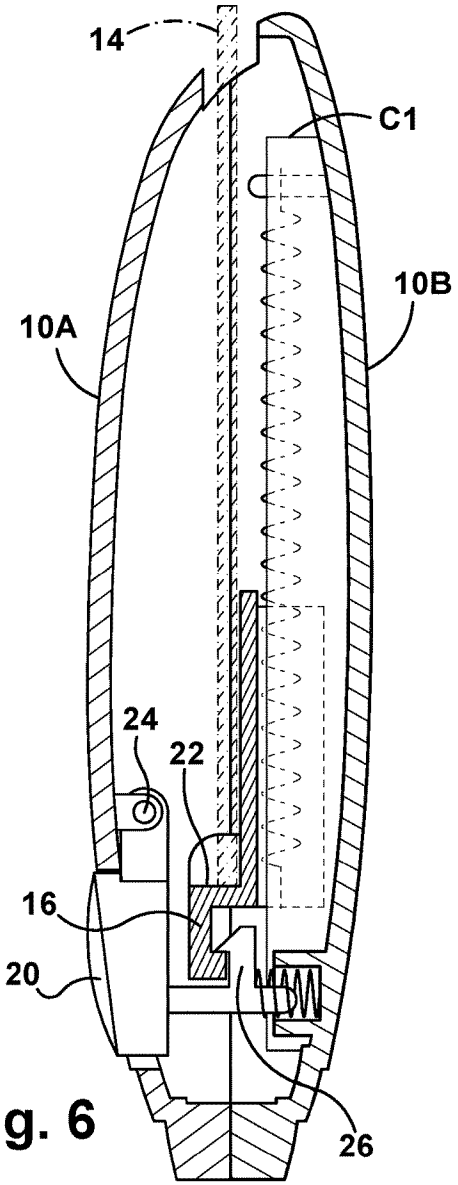
FIG. 6 is a cross-sectional view of the gift card holder of FIG. 1, in the direction of arrows 6-6.
Figure 10:
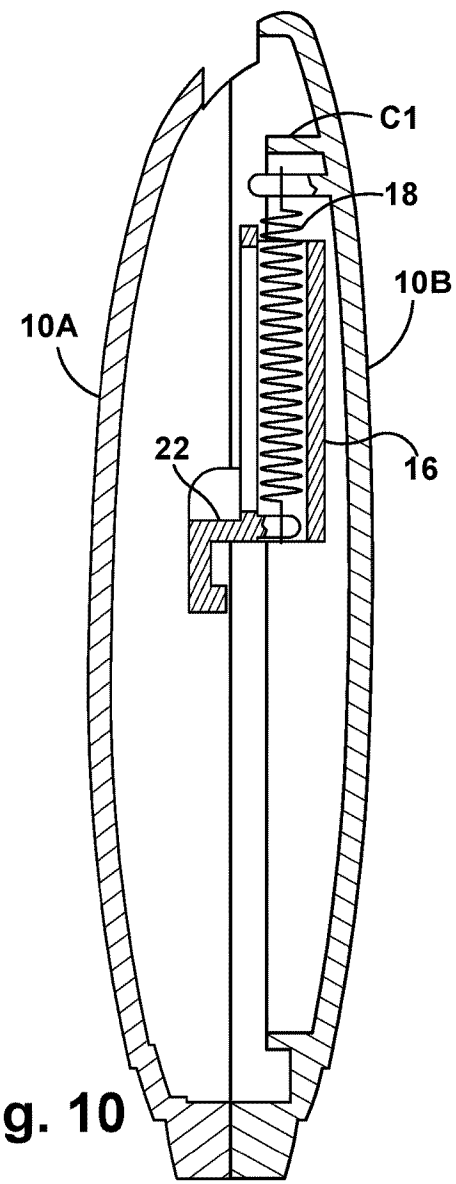
FIG. 10 is a cross-sectional view of the gift card holder of FIG. 2, in the direction of arrows 10-10.
Figure 9:
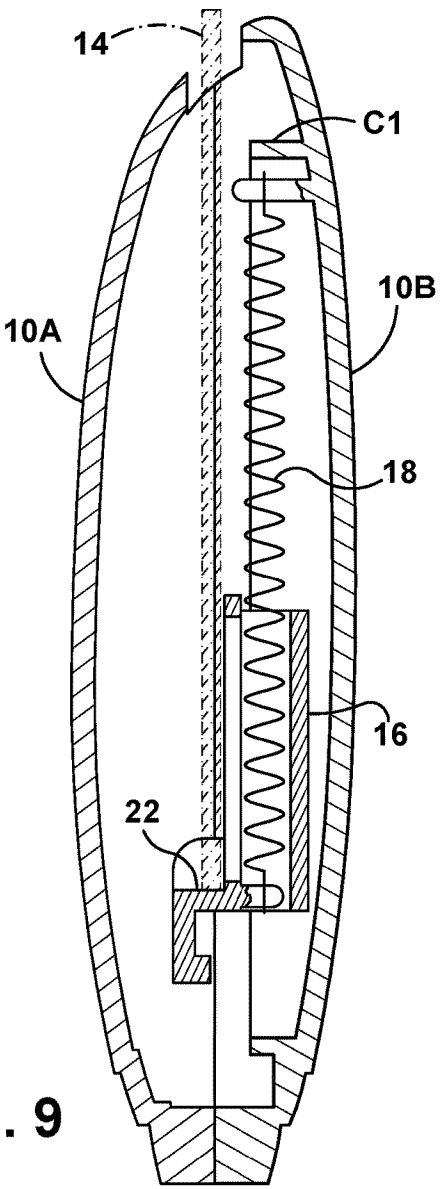
FIG. 9 is a cross-sectional view of the gift card holder of FIG. 1, in the direction of arrows 9-9.

The internal mechanics of the gift card presentation device 10 of the present disclosure and related inventions may include but are not limited to: at least one spring 18; a lever panel 16, and a push button 20, as shown in FIG. 3. In the embodiment shown in the figures, as discussed above, the gift card presentation device 10 contains a front surface panel 10A and a rear surface panel 10B. The internal surfaces of both the front and rear surface panels 10A, 10B may have various features which operate to either attach the front and rear surface panels 10A, 10B to one another or to facilitate movement of the springs 18 between compressed and decompressed positions. The internal surface of the rear surface panel 10B contains two elongate, vertical slots or cavities C1, into which the springs 18 are positioned. Two additional elongate, vertical slots or cavities C2 are also contained on the internal surface of the rear surface panel 10B. These slots or cavities C2 interact with the lever panel 16 to ensure that it stays on track as it moves up and down as the springs 18 move between compressed and non-compressed positions. The internal surface of the rear surface panel 10B may also contain one or more round cavities which are operative to mate with pegs P2 located on the inside surface of the front surface panel 10A, to connect the two surfaces 10A, 10B to one another. The front surface panel 10A contains and opening thereon into which the push button 20 is positioned. Two vertically arranged springs 18A, 18B are attached, at one end, to an upper portion of two of the elongate slots or cavities C1 formed on the internal surface of the rear surface panel 10B and at the opposite end to a lever panel 16, as shown in FIGS. 4 and 5. The springs 18 allow the lever panel 16 to move up and down within the gift card presentation device 10 and to eject a gift card 12 or gift card holder 12 from the gift card presentation device 10. The lever panel 16 is located in the cavity between the front and rear surface panels 10A, 10B and contains a lever arm 16A on a right side thereof. The lever arm 16A protrudes outward from between the front and rear surface panels 10A, 10B of the gift card presentation device 10 through an opening S2 in the right side perimeter surface P3, while the rest of the lever panel 16 remains concealed within the cavity between the front and rear surface panels 10A, 10B. The lever panel 16 also contains a small shelf or ledge 22 which serves as a floor or surface onto which a gift card 12 or gift card holder 14 may rest when it is inserted into the horizontal slot or opening 51 at the top of the gift card presentation device 10. The lever panel 16 additionally contains two elongate u-shaped cavities or openings C3 which fit within two of the elongate cavities C2 located on the internal surface of the rear surface panel 10B to keep the lever panel 16 in place or on track as it slides up and down when the springs 18 are moved between compressed and decompressed states. A push button 20 is located in the opening on the front surface panel 10, as described above. The push button 20 is attached to a hinge 24 located on the inside surface of the front surface panel 10A, such that push button 20 can partially pivot about the hinge 24. An arm or a catch 22 is attached to the inside surface of the push button 20. The arm or catch 22 interacts with the lever panel 16 to move the springs 18 between the compressed and decompressed positions. For example, the arm or catch 22 latches onto a bottom or lower surface of the lever panel 16 to retain the lever panel 16 in a first position where it is located in a lower section within the gift card presentation device 10, as shown in FIGS. 4 and 6. When the push button 20 is pressed inward, the push button 20 pivots about the hinge 24, moving the arm or catch 22 in an upward direction thereby releasing the arm or catch 22 from attachment to the lever panel 16, as shown in FIGS. 5, 7 and 8. When the lever panel 16 is released, the springs 18 are free to return to an uncompressed state, thereby moving the lever panel 16 upward to a second position, in an upper section within the gift card presentation device 10 and ejecting the gift card 12 or gift card holder 14 from within the gift card presentation device 10.

As noted above, there is a horizontal slot 51 at the top surface P1 of the gift card presentation device 10. A gift card 12 or gift card holder 14 may be placed into the slot 51 and come to rest on a ledge 22 located on the lever panel 16 which is located between the front and rear surface panels 10A, 10B of the gift card presentation device 10, as shown in FIGS. 4, 6 and 7. Most of the lever panel 16 is concealed between the surface panels 10A, 10B except for the lever arm 16A which protrudes outward through the opening S2 in the right perimeter surface P3 of the gift card presentation device 10. A standard gift card 12 or gift card holder (with or without a gift card contained therein) 14 can be placed into the slot 51. When inserted into the slot 51, the gift card 12 or gift card holder is partially concealed inside the gift card presentation device 10 with a portion of the gift card 12 or gift card holder 14 visible about the slot 51, as shown in FIG. 1. Examples of gift card holders include a miniature greeting card, an envelope, a pocket or sleeve other any other mechanism or device for holding a gift card therein. In one embodiment, as shown in the figures, the gift card holder 14, is a miniature greeting card having two panels attached along a fold line, which are shaped like a slice of bread. One of the two panels may contain one or more slot thereon for accepting a gift card 12 therein. The gift card holder 14 may be made of cardstock or other similar material. Other materials have been contemplated and are considered to be within the scope of the present invention. Alternatively, a gift card 12 may be attached to the gift card holder 14 via adhesive or other releasable attachment device.

In operation, after purchase, a gift giver may remove the gift card holder 14 from the gift card presentation device 10 and insert a gift card 12 therein for presentation to a recipient. The lever arm 16A of the lever panel 16 may initially be in a first position at the bottom end of the slot S2 on the right perimeter surface P3 of the gift card presentation device (see FIGS. 1 and 4) When the lever arm 16A is located in the first position, the lever panel 16 is located in a lower region of the cavity between the front and rear surface panels 10A, 10B and the lever panel 16 is attached to the catch or arm 22 located on the push button 20, as shown in FIGS. 4 and 6. When the recipient receives the gift card presentation device 10, he/she can push the push button 20, which, as described above, will pivot inward about a hinge 24 thereby releasing the lever panel 16 from the catch or arm 22 located on the push button 20, as shown in FIG. 7. The lever panel 16 and lever arm 16A move from the first position (at the bottom of the slot S2 and in a lower area of the cavity between the front and rear surface panels 10A, 10B) to a second position, where the springs 18 force the lever panel 16 and lever arm 16A upward so that the lever arm 16A now rests at the top of the slot S2 and the lever panel 16 is located in an upper region of the cavity between the front and rear surface panels 10A, 10B, as shown in FIGS. 5 and 8. The force of the springs 18 causes the lever panel 16 to move with such speed that the gift card holder 14 that was placed in the main slot 51 is completely ejected from within the gift card presentation device 10, as shown in FIG. 2. The gift card presentation device 10 can be reset by pushing down on the lever arm 16A until the lever panel 16 re-attaches to the arm or catch 22 on the push button 20.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A gift card presentation device comprising:

a device having a front surface and a rear surface opposite the front surface, four perimeter surfaces between the front and rear surfaces, and a cavity contained between the front, rear and four perimeter surfaces;

a spring loaded lever panel attached to a lever arm;

a push button with a catch arm, the push button attached to the device via a hinge;

a gift card holder inserted within a slot located on one of the four perimeter surfaces of the device, the gift card holder resting on a portion of the spring loaded lever panel;

wherein pushing the push button causes the spring loaded lever panel to move from a first position at a lower region of the device to a second position at an upper region of the device and also causes the gift card holder to be completely ejected from the device.

2. The gift card presentation device of claim 1, wherein the device may be reset by moving the spring loaded lever panel back to the first position by pushing downward on the lever arm.

3. The gift card presentation device of claim 1, wherein two springs are attached at one end to the device and at another end to the spring loaded lever panel.

4. The gift card presentation device of claim 1, wherein the gift card holder contains a gift card therein.

5. The gift card presentation device of claim 1, wherein the spring loaded lever panel is concealed within the device and the lever arm extends out of the device via a slot on one of the perimeter surfaces of the device.

6. The gift card presentation device of claim 1 wherein in the device is shaped and modeled as a faux toaster and the gift card holder is shaped like a slice of bread.

7. A gift card presentation device comprising:

a faux toaster having a front surface, rear surface, right and left perimeter surfaces and upper and lower perimeter surfaces;

at least one spring contained within the faux toaster, the at least one spring operative to move between a compressed and non-compressed state;

a lever contained inside of the faux toaster which is attached to the at least one spring;

a lever arm attached to the lever which extends outward from the right perimeter surface of the faux toaster;

a push button which is removably attached to the lever;

a gift card holder shaped like a slice of bread, the gift card holder located atop portion of the lever;

wherein when the push button is attached to the lever arm, the at least one spring is in a compressed state; and wherein pushing the push button releases the lever from the push button, causing the spring to return to an non-compressed state and thereby moving the lever in an upward direction and forcing the gift card holder from within the faux toaster.

8. The gift card presentation device of claim 7, wherein the faux toaster can be reset by re-connecting the lever to the push button by pushing downward on the lever arm.

9. The gift card presentation device of claim 7, wherein the gift card holder is a miniature greeting card.

10. The gift card presentation device of claim 7, wherein the gift card holder contains one or more slots thereon for retaining a gift card therein.

11. The gift card presentation device of claim 7, wherein the gift card holder is inserted into and ejected out of the faux toaster through a slot located on the upper perimeter surface of the faux toaster.

12. The gift card presentation device of claim 7, wherein when the gift card holder is contained within the faux toaster, a portion of the gift card holder is visible above the top of the faux toaster.

13. The gift card presentation device of claim 7, wherein the at least one spring is attached at one end to an inside surface of the faux toaster and the opposite end to the lever.

14. A gift card presentation device comprising;

a device body having a cavity contained therein;

a lever contained within the cavity in the device body;

a push button releasably attached to the lever;

a gift card holder partially contained within the device body;

one or more springs attached at one end to an internal surface of the device body and at an opposite end to the lever;

wherein attaching the lever to the push button forces the one or more springs into a compressed state; and wherein pushing the push button releases the lever from the push button, causes the one or more springs to return to an uncompressed state, forces the lever in an upward direction and ejects the gift card holder from within the device body.

15. The gift card presentation device of claim 14 further comprising a lever arm attached to the lever.

16. The gift card presentation device of claim 14, wherein the gift card holder is inserted into and ejected out from the device body via a slot located on the device body.

17. The gift card presentation device of claim 14, wherein the gift card holder is a miniature greeting card.

18. The gift card presentation device of claim 15, wherein the lever arm extends outside the device body.

19. The gift card presentation device of claim 15, wherein the lever can be reattached to the push button by pushing downward on the lever arm.

* * * * *